US007993170B2

(12) United States Patent
Nakata et al.

(10) Patent No.: US 7,993,170 B2
(45) Date of Patent: Aug. 9, 2011

(54) TERMINAL FITTING AND A CONNECTOR

(75) Inventors: Takehiro Nakata, Yokkaichi (JP); Kenji Okamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/754,328

(22) Filed: Apr. 5, 2010

(65) Prior Publication Data

US 2010/0255734 A1 Oct. 7, 2010

(30) Foreign Application Priority Data

Apr. 7, 2009 (JP) ..... 2009-093094

(51) Int. Cl.
*H01R 4/10* (2006.01)

(52) U.S. Cl. ..... 439/877; 439/587

(58) Field of Classification Search ..... 439/585, 439/595, 877, 587
See application file for complete search history.

(56) References Cited

U.S. PATENT DOCUMENTS 5,145,409 A * 9/1992 Sato et al. ..... 439/585
5,246,384 A * 9/1993 Sato ..... 439/877
5,519,170 A * 5/1996 Nabeshima ..... 174/74 R
6,659,811 B2 12/2003 Okamoto et al.
6,951,483 B2 * 10/2005 Kameyama ..... 439/595
6,953,365 B2 * 10/2005 Tabata et al. ..... 439/587
7,140,915 B2 * 11/2006 Casses et al. ..... 439/752
7,211,731 B2 * 5/2007 Nagamine et al. ..... 174/74 R
7,285,013 B1 * 10/2007 Tabata ..... 439/587
7,658,644 B2 * 2/2010 Ahn ..... 439/587
7,695,330 B2 * 4/2010 Noda et al. ..... 439/877

FOREIGN PATENT DOCUMENTS

DE 10212660 11/2002
JP 5038766 5/1993
WO 2007094406 8/2007
WO 2009078414 6/2009

* cited by examiner

*Primary Examiner* — Briggitte R Hammond
(74) *Attorney, Agent, or Firm* — Gerald E. Hespos; Michael J. Porco

(57) ABSTRACT

A terminal (20) has a terminal main body (51) with a projection (55) to be engaged with a retainer (40). A wire barrel (21) to be crimped to a core (11) of a wire (10), an insulation barrel (23) to be crimped to an insulating coating (12) and a rubber plug barrel (24) to be crimped to a rubber plug (15) are successively arranged behind the main body (51). Bottom parts of the wire barrel (21) and the insulation barrel (23) are at low positions having substantially the same height. A front end of the wire barrel (23) is crimped flat to suppress bend-up of the core (11). The front end of the crimped wire barrel (21) is insertable to a position facing a projecting end of the retainer (40) when the terminal (20) is inserted to a proper position in a cavity (31) of a housing (30).

9 Claims, 11 Drawing Sheets

TERMINAL FITTING AND A CONNECTOR

BACKGROUND OF THE INVENTION

1. Field of the Invention

The invention relates to a terminal fitting and a connector.

2. Description of the Related Art

U.S. Pat. No. 6,659,811 discloses a waterproof connector with a housing that has a cavity. The connector also has a terminal fitting and a rubber plug that are fixed to an end of an insulated wire. The rubber plug is fit into the entrance of the cavity for sealing as the terminal fitting is retained and accommodated in the cavity.

The terminal fitting has a rectangular tubular main body with a connecting portion for connecting to a mating terminal. A wire barrel and an insulation barrel are provided behind the terminal main body. Insulating coating is stripped off an end of the insulated wire to expose an end of a core. A mounting tube projecting from the front surface of the rubber plug is fit on the outer circumferential surface of the end of the remaining insulating coating. The wire barrel then is crimped into connection with the end of the core and the insulation barrel is crimped to the end of the insulating coating and to the mounting tube of the rubber plug on the end of the insulating coating. The terminal fitting that has been fixed to the insulated wire and the rubber plug is inserted into a corresponding cavity of the housing from behind and is locked primarily by a resin locking lance in the cavity. A retainer assembled into the housing while projecting down from a ceiling of the cavity is engaged with an upper part of a rear end of the terminal main body to lock the terminal fitting redundantly.

Insulated wires have been made thinner, for example, to reduce the weight of a wiring harness. However, the thinning of the wires may lead to fractures due to a reduction in wire strength and the like. This is particularly notable in a wire having the terminal fitting and a rubber plug fixed to the end, as described above. More particularly, the wire barrel is crimped directly to the end of the core of such a wire to exhibit a large fixing force, whereas the insulation barrel is crimped to the end of the insulating coating via the mounting tube of the rubber plug to exhibit a small fixing force. Thus, the core may elongate, while the insulating coating with a small fixing force scrapes through and slips out from the insulation barrel and accordingly the core may break, for example, when the insulated wire is pulled strongly backward. The rubber plug also may scrape through and slip out from the entrance of the cavity together with the insulated wire.

A three-barrel terminal fitting has been proposed to address the above-described problems. The three-barrel terminal fitting has an insulation barrel crimped directly to an end of an insulating coating to increase a fixing force of an insulated wire. A rubber plug barrel also is proposed for crimped connection to the rubber plug. However, a long area is necessary for three barrels. A considerable shape change of a housing, such as a change in the length of the cavity, is necessitated if the entire length of the terminal fitting is extended for this purpose. The foremost wire barrel must be closer to the terminal main body if the entire length of the terminal fitting is assumed to remain unchanged, and this more forward wire barrel may interfere with a retainer to be inserted to a position behind the terminal main body for doubly locking the terminal fitting. A differently configured retainer may be necessary to avoid interference. The front end of the wire barrel could be retracted to avoid interference with the retainer. However, the retracted wire barrel is smaller and may not achieve sufficient contact performance. Hence, the above-described problem cannot be dealt with easily.

The invention was developed in view of the above situation and an object thereof is to provide a terminal fitting which exhibits a good tensile strength when an insulated wire is pulled and can be used without changing the design of an existing housing, and a connector using this terminal fitting as well as an assembling method therefor.

SUMMARY OF THE INVENTION

The invention relates to a terminal fitting to be fixed to an end of an insulated wire together with a resilient plug. The terminal fitting and the rubber plug are to be inserted into a cavity of a housing and retained by a retainer to be mounted to project inside the cavity. A terminal main body is formed at a front end of the terminal fitting and includes an engageable portion to be engaged with the retainer. A wire barrel, an insulation barrel and a plug barrel are arranged successively behind the terminal main body. The wire barrel is to be crimped and connected to an end of a core of the stripped insulated wire. The insulation barrel is to be crimped and connected to an insulating coating. The plug barrel is to be crimped and connected to a mounting tube of the resilient plug mounted on the outer circumferential surface of the insulating coating. Bottom parts of the wire barrel and the insulation barrel are arranged at low positions having substantially the same height. A front end portion of the wire barrel is crimped substantially flat to suppress a bend-up of the end of the core, and the front end of the crimped wire barrel is insertable to a position substantially facing a projecting end of the retainer when the terminal fitting is inserted to a proper position in the cavity. The terminal fitting exhibits a good tensile strength when an insulated wire is pulled and can be used without changing the design of an existing housing.

The wire barrel and the insulation barrel respectively are crimped directly to the end of the core of the insulated wire and the end of the insulating coating. Thus, the terminal fitting has a good tensile strength when the insulated wire is pulled backward in a state where the terminal fitting and the resilient plug are retained in the cavity of the housing. Accordingly, will not elongate or fracture and the resilient plug will not come out of the cavity.

An attempt could be made to provide an insulation barrel for direct crimped connection to the end of the insulating coating to ensure a length of the wire barrel comparable to a length of a wire barrel of a two-barrel terminal to suppress contact resistance with the core substantially to the same level while keeping the entire length of the terminal fitting equal to that of the two-barrel terminal. However, the wire barrel would be closer to the terminal main body and the front end of the wire barrel would reach the retainer when the terminal fitting is inserted to a proper position in the cavity of the housing.

In contrast, the terminal fitting of the subject invention has the bottom of the wire barrel at substantially at the same low position as the bottom of the insulation barrel, the front end portion of the wire barrel is crimped substantially flat to suppress bend-up of the end of the core, and the front end of the crimped wire barrel is insertable to a position facing the projecting end of the retainer. In other words, neither the wire barrel nor the end of the core will interfere with the retainer mounted to a locking position. Accordingly, a housing for two-barrel terminals can be used without a design change and the three-barrel terminals can be dealt with inexpensively.

The terminal fitting may have the following construction.

The wire barrel is formed so that two barrel pieces stand up from the opposite lateral edges of a base plate that extends backward from a bottom plate of the terminal main body.

The both barrel pieces may be crimped to embrace the end of the core with projecting end edges thereof butted against each other.

A bellmouth may be formed only at a rear end in the crimped wire barrel. Thus, the front end of the crimped wire barrel can be inserted to the position facing the projecting end of the retainer.

The wire barrel may be crimped directly and individually into connection with the end of the core of the insulated wire and the insulation barrel may be crimped directly and individually into connection the end of the insulating coating.

The invention relates to a connector that comprises a housing and at least one of the above-described terminal fittings fixed to an end of an insulated wire together with a resilient plug and at least partly inserted into a cavity of the housing. The connector may also include a retainer mounted into the housing and projecting into the cavity.

Accordingly, there can be obtained a terminal fitting which exhibits a good tensile strength when an insulated wire is pulled and can be used without changing the design of an existing housing, and a connector using this terminal fitting.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 4:
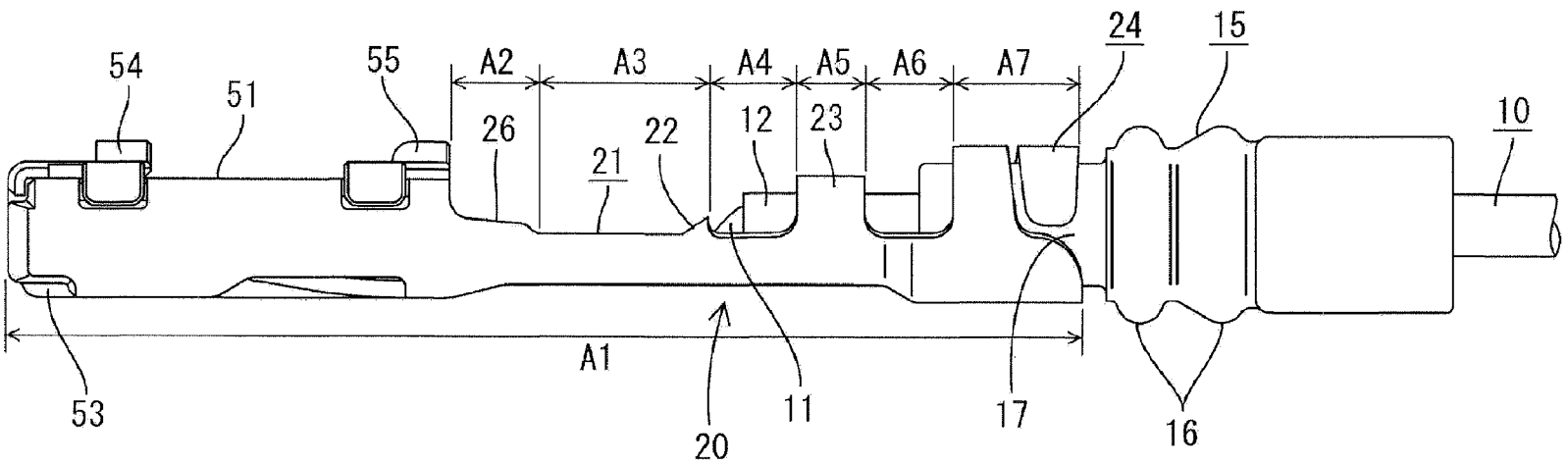
FIG. 4 is a side view showing the state of FIG. 3.
Figure 5:
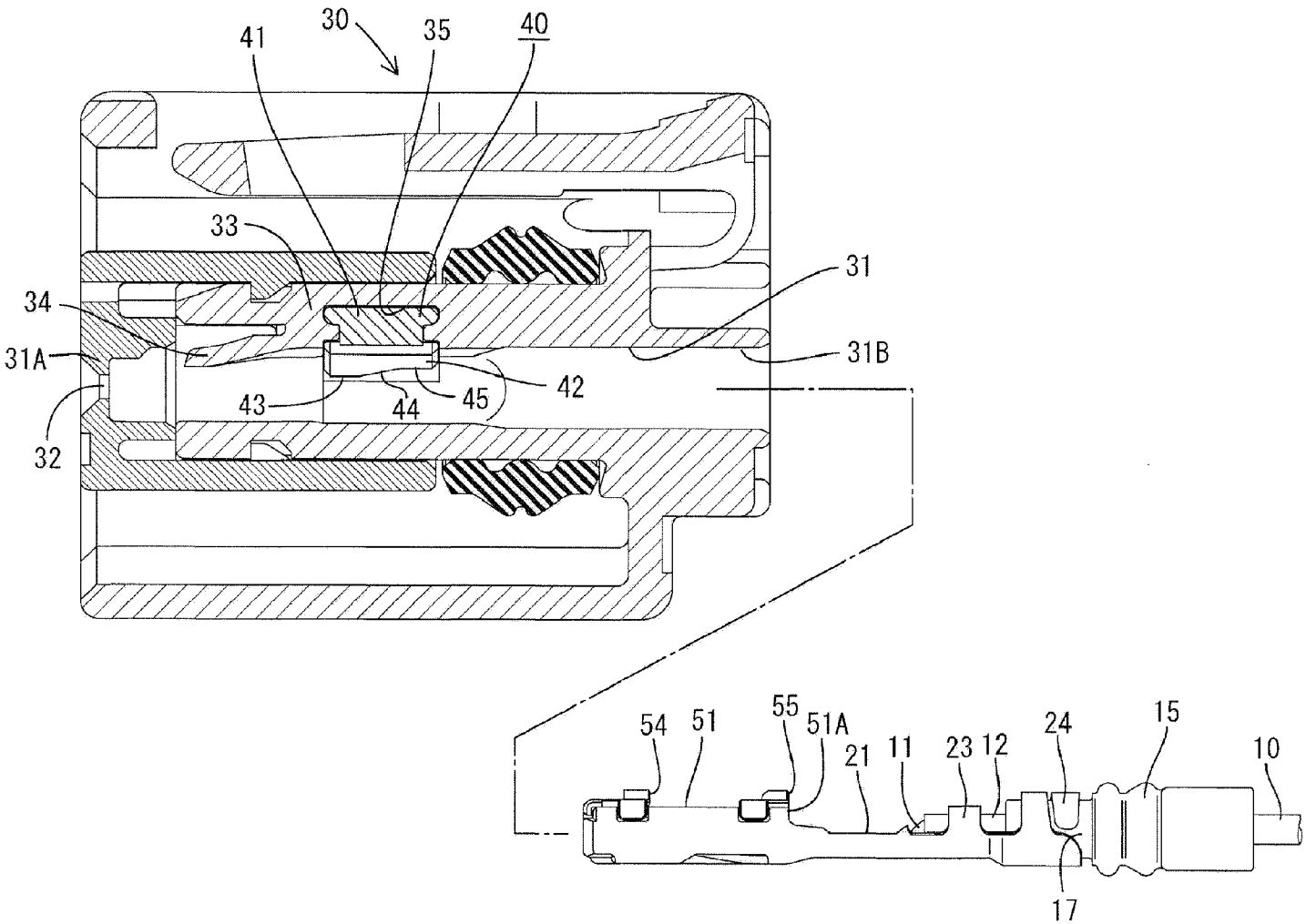
FIG. 5 is a longitudinal section showing an operation of inserting the terminal fitting into a cavity of a housing.
Figure 6:
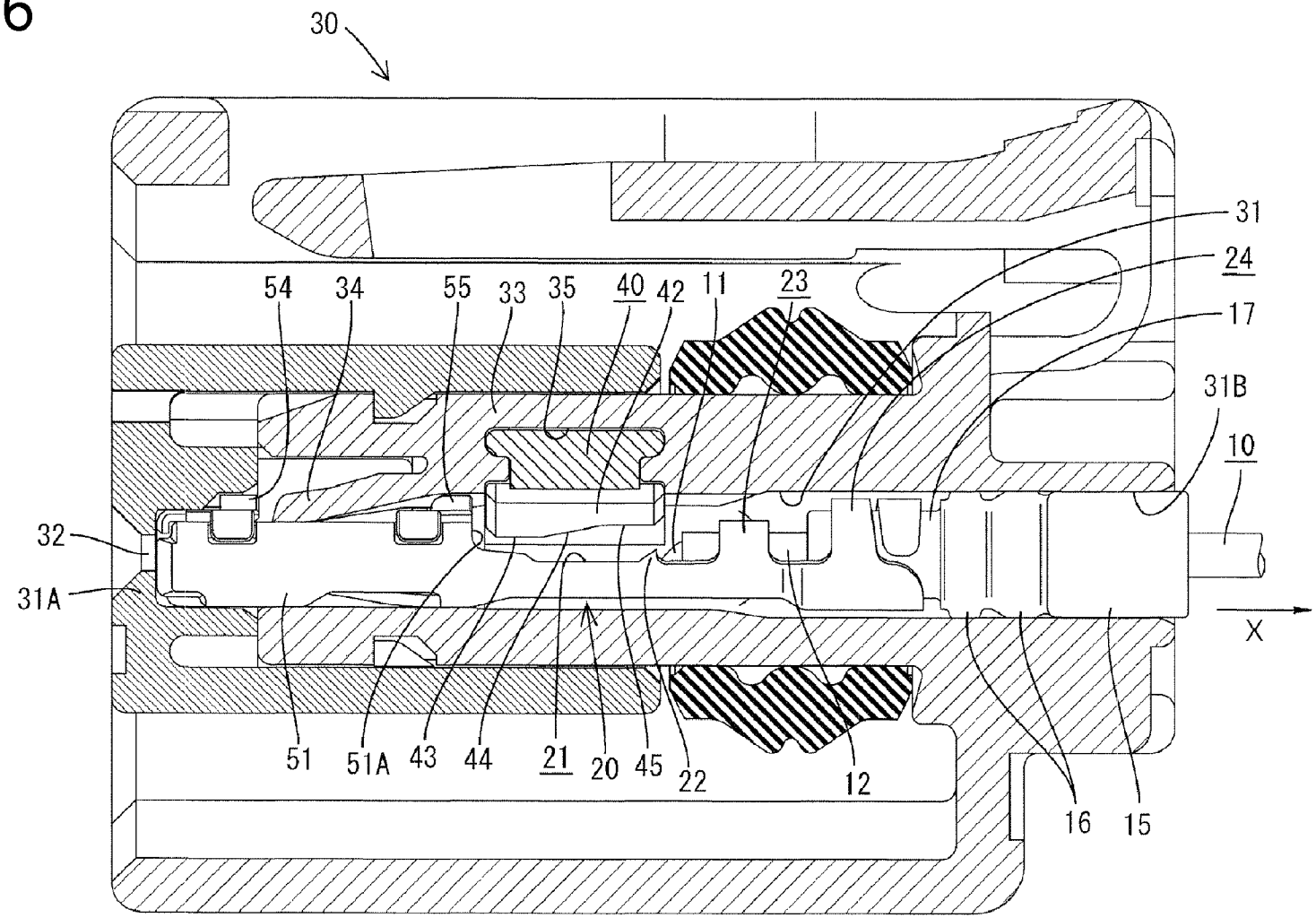
FIG. 6 is a longitudinal section showing a state where the terminal fitting is retained and accommodated in the cavity.

A two-pole waterproof connector using a three-barrel terminal fitting in accordance with the invention is illustrated in FIGS. 1 through 4 and can be used, for example, with a two-pole waterproof connector as shown in FIGS. 5 and 6. In contrast, a prior art two-barrel terminal fitting and an associated connector are shown in FIGS. 7 through 11.

Figure 10:
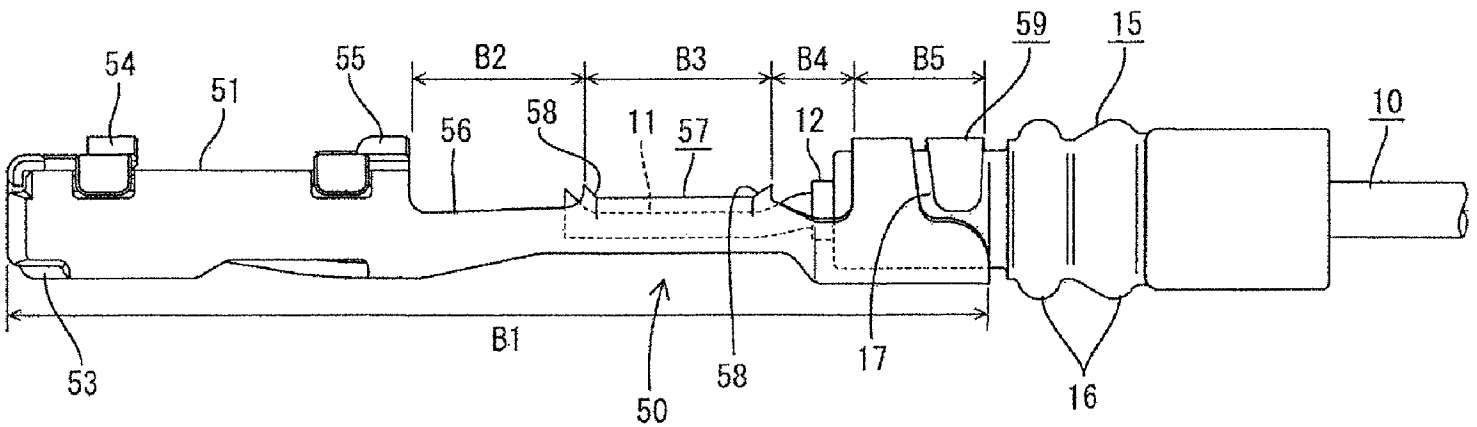
FIG. 10 PRIOR ART
FIG. 10 is a side view showing the state of FIG. 9.

The known two-barrel terminal fitting is identified generally by the numeral 50 in FIGS. 7 to 11. The two-barrel terminal 50 is fixed to an end of an insulated wire 10 together with a rubber plug 15. The insulated wire 10 has a core 11 made by twisting a plurality of thin metal wires that are surrounded by an insulating coating 12 made e.g. of synthetic resin as shown in FIG. 10 (FIG. 4).

Figure 7:
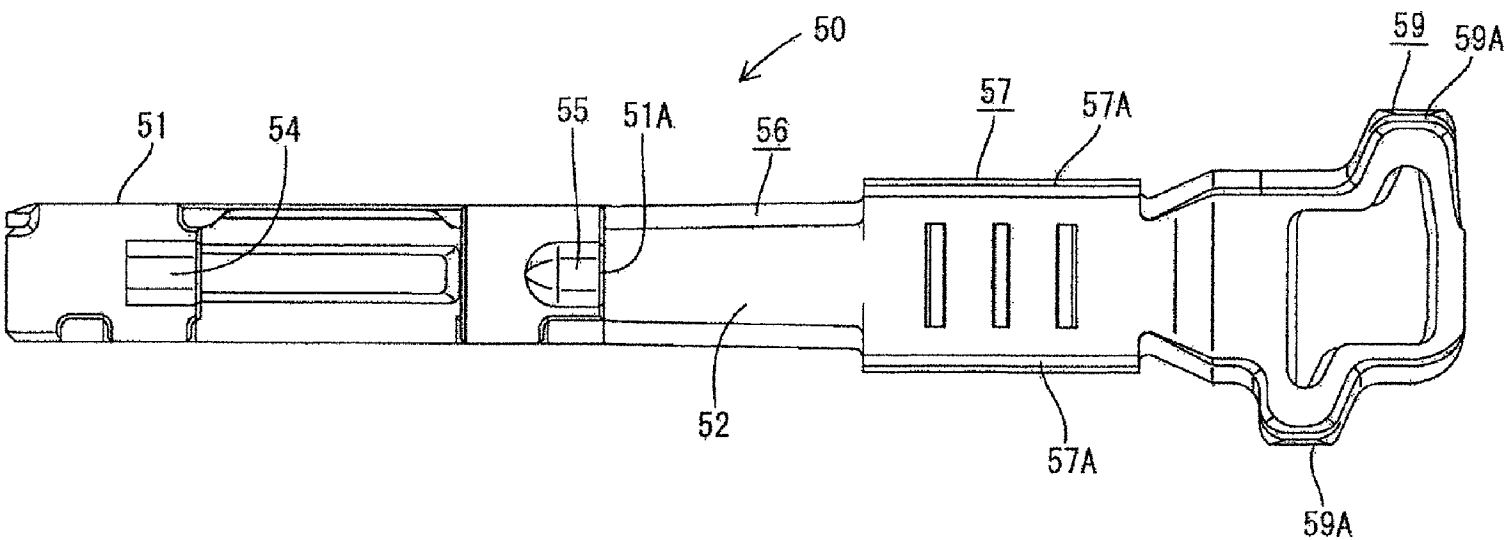
FIG. 7 PRIOR ART
FIG. 7 is a plan view of a prior art two-barrel terminal.
Figure 8:
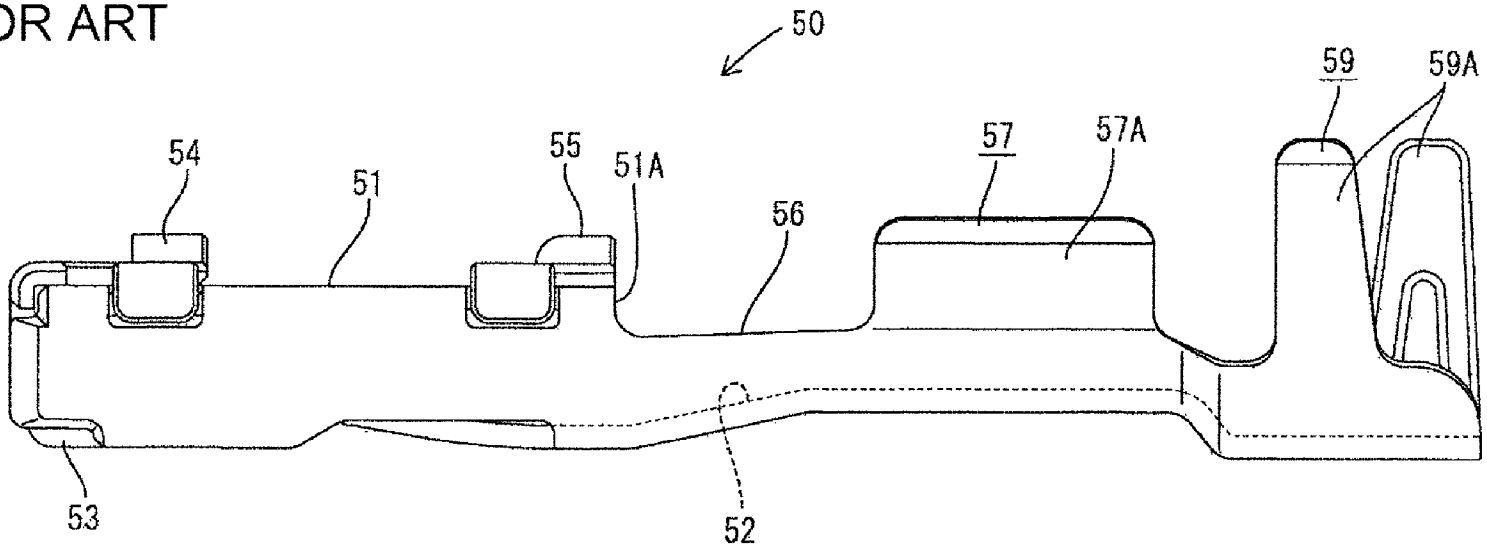
FIG. 8 PRIOR ART
FIG. 8 is a side view of the two-barrel terminal.
Figure 9:
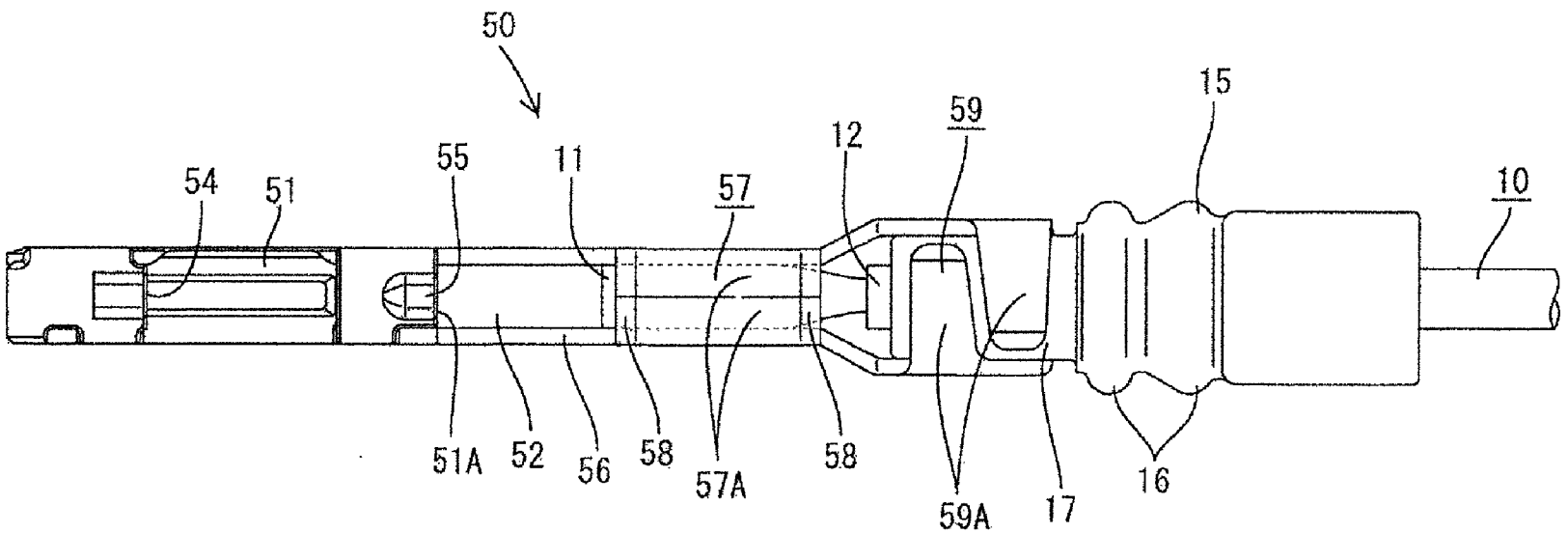
FIG. 9 PRIOR ART
FIG. 9 is a plan view showing a state where the two-barrel terminal is crimped and connected to an end of an insulated wire together with a rubber plug.

The two-barrel terminal 50 is a female terminal fitting, formed by press-working a metal plate of e.g. copper alloy or the like, and structured such that a wire barrel 57 and an insulation barrel 59 are provided behind a terminal main body 51 in the form of a rectangular tube to be electrically connected with a mating male terminal fitting (not shown) as shown in FIGS. 7 and 8.

Exemplary lengths (unit: mm) are shown first. As shown in FIG. 10, entire length B1=15.8, length B3 of the wire barrel 57=3.0, length B5 of the insulation barrel 59=2.5, interval B2 between the terminal main body 51 and the wire barrel 57=2.8 and interval B4 between the insulation barrel 57 and the insulation barrel 59=1.3.

A resilient contact piece 53 is folded back or bent from (particularly the front edge of) a bottom plate 52 in the terminal main body 51. A tab of the above mating male terminal fitting is at least partly inserted into the terminal main body 51 from front and brought into resilient contact with the resilient contact piece 53, whereby the male terminal fitting and the two-barrel terminal 50 are electrically connected.

A front engageable projection 54 to be engaged with a locking lance 34 provided in a housing 30 is formed at a position on the upper surface of the terminal main body near its front end, and a rear engageable projection 55 to be engaged with a retainer 40 is formed at the rear end of this upper surface.

The wire barrel 57 is an open barrel, wherein a pair of left and right wide barrel pieces 57A stand up or project from the lateral (left and/or right) edge(s) of the bottom plate 52 particularly while substantially facing each other. The wire barrel 57 is to be crimped or bent or folded or deformed and connected to the end of the core 11 of the above insulated wire 10, and the both barrel pieces 57A are so crimped or bent or folded or deformed (particularly substantially in a heart shape) as to embrace the outer circumferential surface of the end of the core 11, particularly from the opposite left and right sides while having the projecting ends thereof butted against each other.

The insulation barrel 59 is likewise an open barrel, wherein one or more, preferably a pair of lateral (left and right) barrel pieces 59A narrower, but taller than the barrel pieces 57A of the wire barrel 57 stand up or project from the lateral (left and/or right) edge(s) of the bottom plate 52 while particularly being displaced in forward and backward directions.

On the other hand, a resilient plug, particularly a rubber plug 15 having a mounting tube 17 projecting from its front surface is mounted on an end of the insulating coating 12 remaining on the insulated wire 10, and the above insulation barrel 59 is crimped or bent or folded or deformed and connected to the end of the insulating coating 12 and the mounting tube 17 of the resilient (rubber) plug 15. The insulation barrel 59 is so crimped or bent or folded or deformed as to embrace the outer circumferential surface of the mounting tube 17 of the resilient (rubber) plug 15 with the (particularly both) barrel piece(s) 59A displaced from each other in forward and backward directions.

A procedure of crimping or bending or folding or deforming and connecting the two-barrel terminal 50 and the rubber plug 15 as a preferred resilient plug to the end of the insulated wire 10 is as follows.

The resilient (rubber) plug 15 is first mounted on the end of the insulated wire 10 and the end of the insulating coating 12 of the insulated wire 10 is stripped off with the resilient (rubber) plug 15 temporarily retracted backward to expose an end of the core 11 by a specified length. Thereafter, the resilient (rubber) plug 15 is moved forward and the mounting tube 17 is fitted on the outer circumferential surface of an end of the remaining insulating coating 12.

Then, using a crimping machine, the two-barrel terminal 50 is crimped or bent or folded or deformed and connected to the end of the insulated wire 10 together with the rubber plug 15. Specifically, the crimping machine includes an anvil and a crimper, the exposed end of the core 11 is set in the wire barrel 57 of the two-barrel terminal 50, and the end of the remaining insulating coating 12 and the mounting tube 17 of the resilient (rubber) plug 15 mounted thereon are respectively set in the insulation barrel 59, and the both barrels 57, 59 are squeezed and crimped or bent or folded or deformed between the anvil and the crimper. In this way, the two-barrel terminal 50 is crimped and fixed to the end of the insulated wire 10 together with the rubber plug 15.

Here, bell-mouths 58 gradually widened outward toward front and rear ends are formed in the crimped wire barrel 57 so as to prevent the core 11 from being cut by the opposite front and rear edges of the wire barrel 57. The very end of the core 11 is so bent up as to escape into the front bellmouth 58.

Figure 11:
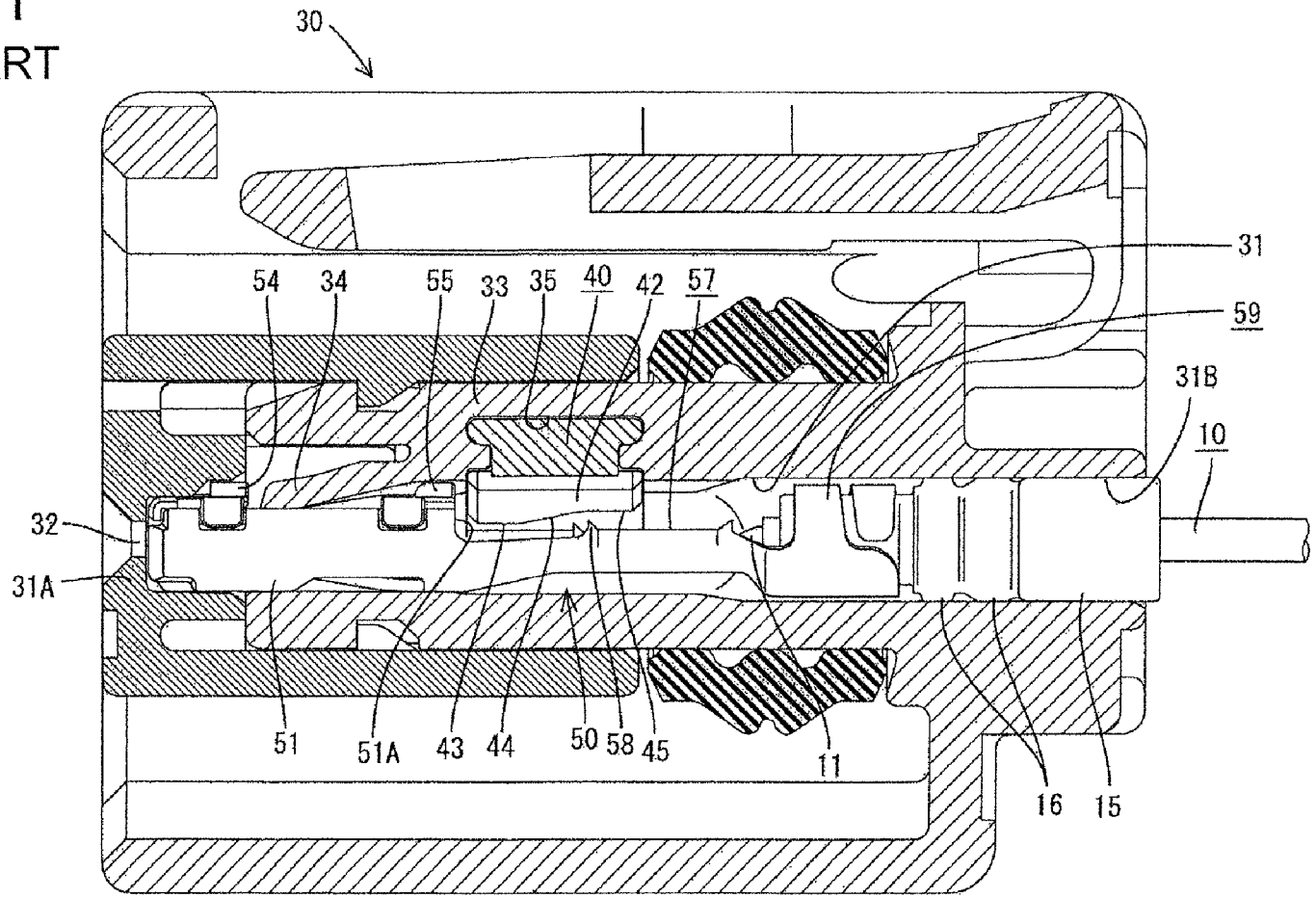
FIG. 11 PRIOR ART
FIG. 11 is a longitudinal section showing a state where the two-barrel terminal is retained and accommodated in the cavity.

Next, the housing 30 is described. The housing 30 is formed with one or more, e.g. two (left and right) cavities 31 which particularly are arranged substantially side by side and into which the above two-barrel terminals 50 connected with the ends of the insulated wires 10 are at least partly inserted from an insertion side, preferably substantially from behind, as shown in FIG. 11 (FIG. 5). A terminal insertion opening 32, into which the tab of the mating male terminal fitting is to be at least partly inserted, is formed in a front wall 31A of each cavity 31, and the resiliently displaceable locking lance 34 to be engaged with the front engageable portion 54 of the two-barrel terminal 50 is provided at a position on a ceiling wall 33 of the cavity 31 near its front end.

A retainer insertion hole 35 is formed to penetrate the lateral or ceiling walls 33 of the (both) cavities 31 in a lateral direction, and the retainer 40 is to be at least partly inserted into and withdrawn from the retainer insertion hole 35 from and toward a lateral (e.g. right) side when the retainer 40 is viewed from front. One or more, e.g. two locking portions 42 to be engaged with the respective rear engageable portions 55 of the two-barrel terminals 50 from a retraction side (e.g. from behind) are formed on the lower surface of a main body 41 of the retainer 40 at the same interval as the respective (left and right) cavities 31. The retainer 40 is held or positioned at a partial locking position (as a preferred first position) where it is relatively lightly inserted into the retainer insertion hole 35 and at a full locking position (as a preferred second position) deeper than the partial locking position. At the partial locking position, the both locking portions 42 of the retainer 40 substantially are retracted laterally of the cavities 31 to permit the insertion of the two-barrel terminals 50 into the cavities 31. Thereafter, when the retainer 40 is pushed or displaced to the full locking position, the respective locking portions 42 at least partly enter the corresponding cavities 31 to be positioned right behind the rear engageable portions 55 of the two-barrel terminals 50 inserted into the cavities 31.

The both locking portions 42 of the retainer 40 substantially are narrow and long in forward and backward directions (particularly equivalent to the length of the wire barrel 57 in forward and backward directions). In a front area of each locking portion 42 divided into three areas in forward and backward directions, the locking portion 42 particularly has a hanging length substantially equal to the entire depth of a jaw portion 51A which is the rear end surface of an upper part of the terminal main body 51 of the two-barrel terminal 50, i.e. substantially reaching the upper surface of a coupling portion 56 arranged between the terminal main body 51 and the wire barrel 57. The hanging length becomes gradually shorter toward the back in a middle or intermediate area and substantially reaches the upper surface position of the terminal main body 51 in a rear area.

In other words, a front area of the lower surface of the locking portion 42 particularly is a flat and lowest surface 43, a rear area thereof is a flat escaping surface 45 retracted upward and a middle or intermediate area thereof particularly is a slanted escaping surface 44 inclined upward toward the back.

The lowest surface 43 in the front area functions to increase an engaging area with the rear engageable portion 55 of the terminal main body 51. Further, the flat escaping surface 45 in the rear area functions to allow the front bellmouth 58 of the crimped wire barrel 57 of the two-barrel terminal 50 to escape and the slanted escaping surface 44 in the middle area functions to allow the bent-up end of the core 11 to escape.

One or more lips 16 on the outer circumferential surface of the resilient (rubber) plug 15 are tightly fitted into a rear end portion of the cavity 31 while being resiliently deformed.

As described above, the two-barrel terminal(s) 50 and the resilient (rubber) plug(s) 15 fixed to the end(s) of the insulated wire(s) 10 are at least partly inserted into the one or more corresponding cavities 31 of the female housing 30 with the retainer 40 held at the partial locking position (first position), i.e. with the locking portions 42 laterally retracted from the cavities 31, and the locking lances 34 are engaged (primarily engaged) with the front engageable projections 54 and the resilient (rubber) plugs 15 are tightly fitted into entrances 31B of the cavities 31 when the terminal fittings 50 are inserted to proper positions to come into contact with the front walls 31A of the cavities 31 as shown in FIG. 11.

Thereafter, when the retainer 40 is displaced or pushed from the partial locking position (first position) toward the full locking position (second position) and held or positioned thereat, the one or more respective locking portions 42 of the retainer 40 at least partly enter the one or more corresponding cavities 31 and are engaged (doubly engaged) with the rear engageable projections 55 of the terminal main bodies 51 from behind with large engaging areas (to the entire depths of the jaw portions 51A). Here, the front bellmouths 58 of the wire barrels 57 are allowed to escape into spaces below the flat escaping surfaces 45 of the locking portions 42 and the bent-up portions of the cores 11 are allowed to escape into spaces below the slanted escaping surfaces 44, wherefore there is no likelihood that the retainer 40 interferes with the locking portions 42 when being pushed to the full locking position.

A terminal fitting 20 including three barrels (hereinafter, three-barrel terminal 20) according to this embodiment is descried below. This three-barrel terminal 20 differs from the above two-barrel terminal 50 in an arrangement structure of the barrels although the entire lengths are same. Points of difference from the two-barrel terminal 50 are mainly described below and the similar or same structural parts as the two-barrel terminal 50 are identified by the same reference numerals and briefly or not at all described.

Figure 1:
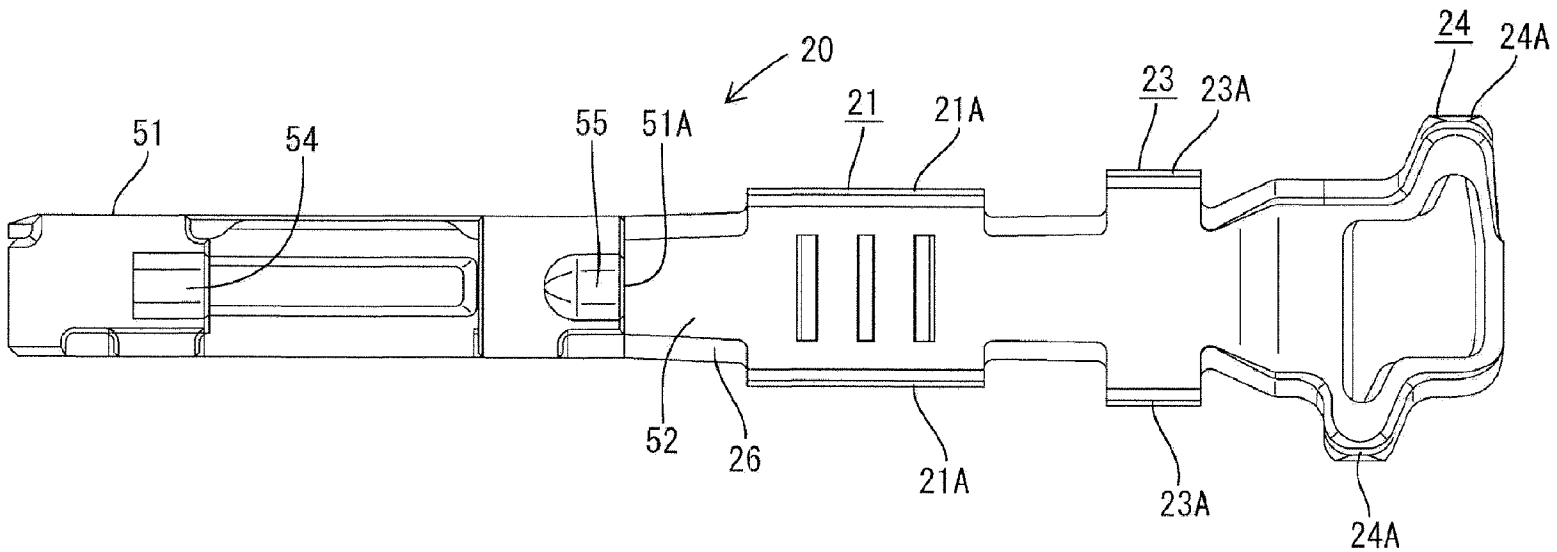
FIG. 1 is a plan view of a terminal fitting according to one embodiment of the invention.
Figure 2:
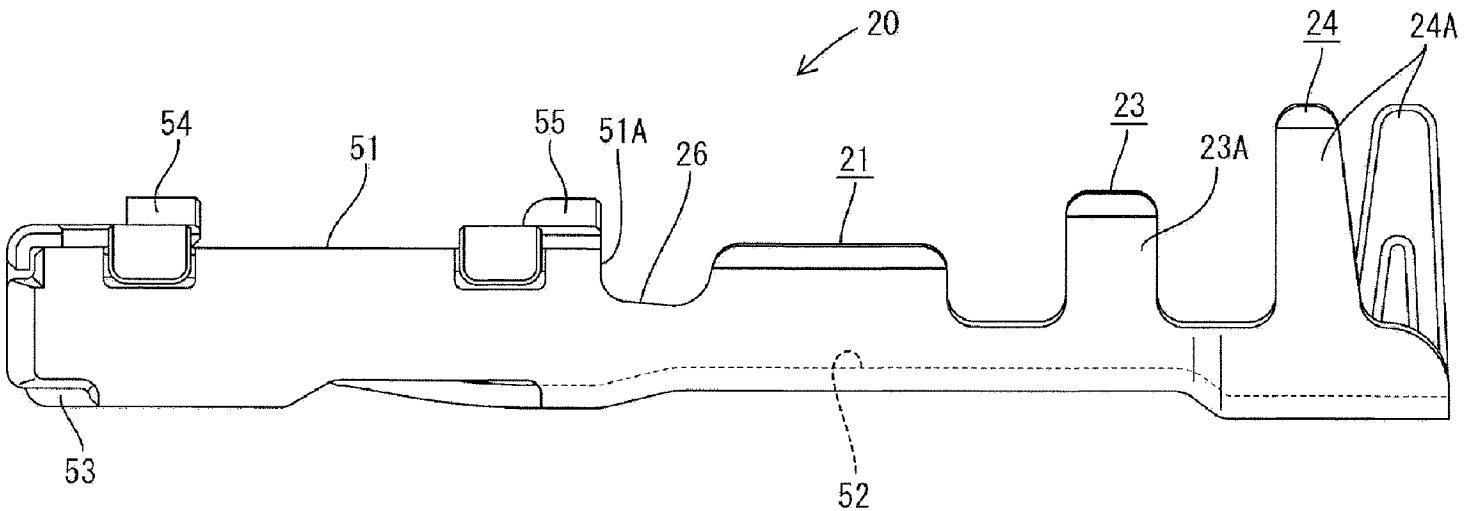
FIG. 2 is a side view of the terminal fitting.
Figure 3:
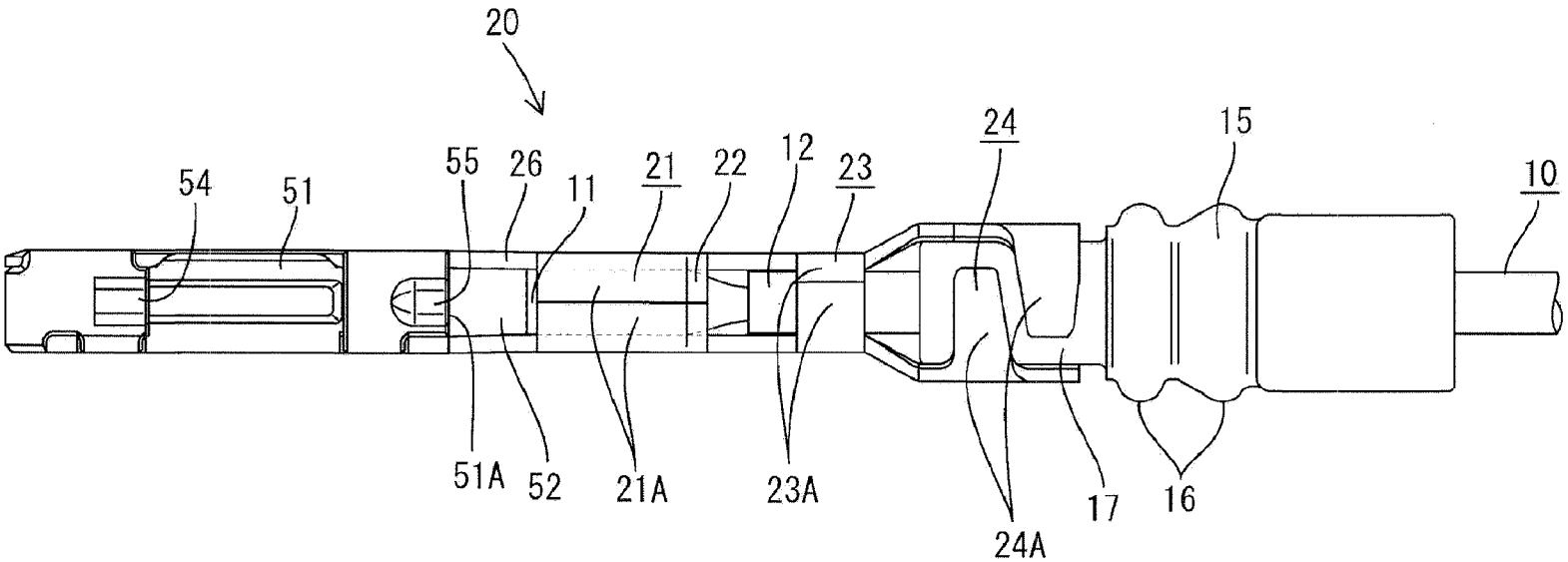
FIG. 3 is a plan view showing a state where the terminal fitting is crimped and connected to an end of an insulated wire together with a rubber plug.

The three-barrel terminal 20 particularly is likewise a female terminal fitting and structured such that a wire barrel 21, an insulation barrel 23 and a resilient or rubber plug barrel 24 are provided behind a terminal main body 51 in the form of a (preferably substantially rectangular or polygonal) tube to be electrically connected with a mating male terminal fitting (not shown) as shown in FIGS. 1 and 2.

Similarly, exemplary lengths (unit: mm) are shown with reference to FIG. 4. Entire length A1=15.8 (same as the entire length B1 of the two-barrel terminal 50), length A3 of the wire barrel 21=2.5, length A5 of the insulation barrel 23=1.0, length A7 of the rubber plug barrel 24=1.9, interval A2 between the terminal main body 51 and the wire barrel 21=1.3, interval A4 between the wire barrel 57 and the insulation barrel 59=1.3 and interval A6 between the insulation barrel 23 and the rubber plug barrel 24=1.3.

The individual barrels 21, 23 and 24 are described. First of all, the resilient or rubber plug barrel 24 is described. This resilient or rubber plug barrel 24 is equivalent to the insulation barrel 59 of the two-barrel terminal 50 in shape and likewise an open barrel, wherein one or more, preferably a pair of narrow and tall barrel pieces 24A stand up or project from the (particularly left and/or right) edge(s) of the bottom plate 52 while particularly being displaced in forward and backward directions. The both barrel pieces 24A are crimped or bent or folded or deformed to embrace the outer circumferential surface of the mounting tube 17 of the resilient plug (particularly of the rubber plug) 15 particularly from the substantially opposite lateral (left and right) sides particularly while being displaced from each other in forward and backward directions.

Points of difference from the insulation barrel 59 of the two-barrel terminal 50 are that the respective barrel pieces 24A are slightly narrower and the front barrel piece 24A is formed at a slightly backward direction to shorten a distance to the rear barrel piece 24A. As a result, the length A7 of the resilient or rubber plug barrel 24 is slightly shorter than the length B5 of the insulation barrel 59 of the two-barrel terminal 50.

The insulation barrel 23 is specific to the three-barrel terminal 20 and likewise an open barrel, wherein one or more, preferably a pair of lateral (left and/or right) narrow barrel pieces 23A stand up or project from the lateral (left and/or right) edge(s) of the bottom plate 52 particularly while substantially facing each other. The bottom plate 52 of the insulation barrel 23 particularly is located more upward than the bottom plate 52 of the resilient or rubber plug barrel 24 by the thickness of the mounting tube 17 of the resilient or rubber plug 15.

This insulation barrel 23 is so crimped or bent or folded or deformed particularly in a so-called overlapping style as to embrace the end of the remaining insulating coating 12 of the insulated wire 10 after stripping from the substantially opposite lateral (left and right) sides with projecting ends of the both barrel pieces 23A at least partly placed one over the other.

Similar to the wire barrel 57 of the two-barrel terminal 50, the wire barrel 21 is formed such that one or more, preferably a pair of lateral (left and/or right) wide barrel piece(s) 21A stand up or project from the lateral (left and/or right) edge(s) of the bottom plate 52 particularly while substantially facing each other. This wire barrel 21 is likewise so crimped or bent or folded or deformed particularly in a so-called heart shape as to at least partly embrace the end of the exposed core 11 of the insulated wire 10 particularly from the substantially opposite lateral (left and right) sides while having the projecting ends thereof butted against each other.

Points of difference from the wire barrel 57 of the two-barrel terminal 50 are that the wire barrel 21 is formed at a position closer to the terminal main body 51 and the width of the barrel pieces 21A, i.e. the length A3 of the wire barrel 21 is slightly shorter (by 0.5 mm). As shown in FIG. 2, the bottom plate 52 of the wire barrel 21 is located at a low position substantially flush with the bottom plate 52 of the insulation barrel 23.

A procedure of crimping or bending or folding or deforming and connecting the three-barrel terminal 20 and the resilient or rubber plug 15 to the end of the insulated wire 10 is as follows.

The rubber plug 15 (as the preferred resilient plug) is first mounted on the end of the insulated wire 10 and the end of the insulating coating 12 of the insulated wire 10 is stripped off with the resilient (rubber) plug 15 temporarily retracted backward to expose the end of the core 11 by a specified (predetermined or predeterminable) length. Thereafter, the resilient (rubber) plug 15 is moved forward. Here, the resilient (or rubber) plug 15 is left at such a position that the end of the remaining insulating coating 12 is exposed by a specified (predetermined or predeterminable) length before the mounting tube 17.

Then, using a crimping machine including an anvil and a crimper, the three-barrel terminal 20 is crimped or bent or folded or deformed and connected to the end of the insulated wire 10 together with the resilient or rubber plug 15. Specifically, the exposed end of the core 11 is set in the wire barrel 21 of the three-barrel terminal 20, the end of the insulating coating 12 is set in the insulation barrel 23 and the mounting tube 17 of the resilient (rubber) plug 15 are set in the resilient (rubber) plug barrel 24, and the respective barrels 21, 23 and 24 are squeezed and crimped or deformed between the anvil and the crimper. In this way, the three-barrel terminal 20 is crimped or deformed and fixed to the end of the insulated wire 10 together with the resilient (particularly rubber) plug 15.

Here, it is particularly worth noting that the insulation barrel 23 is directly crimped or bent or folded or deformed and connected to the end of the insulating coating 12 of the insulated wire 10.

In a part where the wire barrel 21 is crimped or bent or folded or deformed, the very end of the core 11 is substantially flush with or only slightly projects forward from the front end of the wire barrel 21 when the end of the core 11 is arranged in the wire barrel 21. In addition, the wire barrel 21 is so crimped or bent or folded or deformed that a bellmouth 22 is formed only at the rear end side, but no bellmouth is formed at the front end side. Thus, at the front end side of the crimped wire barrel 21, the upper surface preferably is a substantially flat surface and the end of the core 11 is not bent up.

Further, since the bottom plate 52 of the wire barrel 21 particularly is located at the substantially same low position as the bottom plate 52 of the insulation barrel 23, the upper surface of the crimped wire barrel 21 is located at the substantially same position as the upper of the coupling portion 26 arranged between the terminal main body 51 and the wire barrel 21 or lower.

With the entire length of the three-barrel terminal 20 left unchanged, the insulation barrel 23 to be directly crimped and connected to the end of the insulating coating 12 is newly provided. Thus, the wire barrel 21 has to be displaced to a position closer to the terminal main body 51 even if the lengths of the resilient (rubber) plug barrel 24 and the wire barrel 21 are reduced.

Actually, as described later, the front end of the wire barrel 21 reaches the front area of the locking portion 42 of the retainer 40 particularly having the flat lowest surface 43 when the three-barrel terminal 20 is at least partly inserted to a proper position in the corresponding cavity 31 of the housing 30. However, as described above, the upper surface of the crimped wire barrel 21 including the front end part particularly is located at or below the upper surface of the coupling portion 26 and the end of the core 11 is not bent up. Therefore, there is no likelihood that the wire barrel 21 including the end of the core 11 interferes with the locking portion 42 of the retainer 40.

The length of the wire barrel 21 of the three-barrel terminal 20 is shorter (by 0.5 mm) than that of the wire barrel 57 of the two-barrel terminal 50, but no bellmouth is formed at the front side as described above. Thus, a reduction in a contact area of the wire barrel 21 and the core 11 is only small and low resistance is ensured, wherefore a contact property comparable to that of the wire barrel 57 of the two-barrel terminal 50 can be obtained.

Functions of this embodiment are described. The three-barrel terminal 20 and the resilient (rubber) plug 15 are fixed to the end of the insulated wire 10 in the above manner and these three-barrel terminal 20 and the resilient (rubber) plug 15 are at least partly inserted into the corresponding cavity 31 of the housing 30 from the insertion side, particularly substantially from behind, as shown by an arrow in FIG. 5. When the three-barrel terminal 20 is at least partly inserted to the proper position to come substantially into contact with the front wall 31A of the cavity 31 as shown in FIG. 6, the locking lance 34 is engaged (primarily engaged) with the front engageable projection 54 and, concurrently, the resilient (rubber) plug 15 is tightly fitted into the entrance 31B of the cavity 31.

Thereafter, when the retainer 40 is pushed or displaced from the partial locking position (as the preferred first position) toward the full locking position (as the preferred second position) and held or positioned thereat, the respective locking portions 42 of the retainer 40 at least partly enter the corresponding cavities 31 to be engaged (doubly engaged) with the rear engageable projections 55 of the terminal main bodies 51 from a withdrawal side (e.g. from behind) with large engaging areas (to the entire depths of the jaw portions 51A).

Here, in the three-barrel terminal 20, the front end of the wire barrel 21 reaches the front area of the locking portion 42 of the retainer 40 having the substantially flat lowest surface 43 when the three-barrel terminal 20 is inserted to the proper position in the cavity 31. However, the bottom plate 52 of the wire barrel 21 particularly is located at the substantially same low position as the bottom plate 52 of the insulation barrel 23 and no bellmouth is formed at the front end of the wire barrel 21. Thus, the upper surface of the crimped wire barrel 21 including the front end part is located at or below that of the coupling portion 26 and the end of the core 11 is not bent up. Therefore, there is no likelihood that the wire barrels 21 including the ends of the cores 11 interfere with the locking portions 42 of the retainer 40 when the retainer 40 is pushed or displaced to the full locking position (second position).

The fluid- or waterproof connector assembled as described above is connected with a mating male connector (not shown). Here, as shown by an arrow X in FIG. 6, the insulated wire 10 may be pulled backward. In the case of the three-barrel terminal 20 of this embodiment, the wire barrel 21 is crimped or bent or folded or deformed and connected to the end of the core 11 and, in addition, the insulation barrel 23 is directly crimped and connected to the end of the insulating coating 12, wherefore a tensile load is effectively received also by the insulation barrel 23 to reduce the tensile load acting on the wire barrel 21. As a result, a level of a tensile load, which would elongate the core 11 to such an extent as to cause a fracture, is increased, i.e. the wire barrel 21 has good tensile strength. Further, it is prevented that the resilient (particularly rubber) plug 15 protrudes substantially backward from the entrance 31B of the cavity 15 due to the insulating coating 12 scraped and slipped backward.

As described above, since the wire barrel 21 and the insulation barrel 23 particularly are respectively individually directly crimped and connected to the end of the core 11 of the insulated wire 10 and the end of the insulating coating 12 in the three-barrel terminal 20 of this embodiment, this three-barrel terminal 20 has a good tensile strength when the insulated wire 10 is pulled backward in a state where the three-barrel terminal 20 is retained and accommodated in the cavity 31 of the housing 30 together with the resilient (rubber) plug 15. This can prevent the core 11 from being elongated and fractured and the resilient (rubber) plug 15 from protruding from the entrance 31B of the cavity 31.

With the entire length of the three-barrel terminal 20 kept equal to that of the two-barrel terminal 50, the insulation barrel 23 to be directly crimped and connected to the end of the insulating coating 12 is newly provided and the wire barrel 21 has substantially the same length as the wire barrel 57 of the two-barrel terminal 50 to suppress contact resistance with the core 11 substantially to the same level. Thus, the wire barrel 21 has to be displaced to the position closer to the terminal main body 51 and, actually, the front end of the wire barrel 21 reaches the front area of the locking portion 42 of the retainer 40 having the flat lowest surface when the three-barrel terminal 20 is inserted to the proper position in the corresponding cavity 31 of the housing 30.

However, since the bottom plate 52 of the wire barrel 21 particularly is located at the same low position as the bottom plate 52 of the insulation barrel 23 and/or no bellmouth is formed at the front end of the wire barrel 21, the upper surface of the crimped wire barrel 21 including the front end part is or can be located substantially at or below that of the coupling portion 26 and the end of the core 11 is not bent up. Therefore, there is no likelihood that the wire barrels 21 including the end of the core 11 interferes with the locking portions 42 of the retainer 40 when the retainer 40 is pushed to the full locking position.

In other words, for the housing 30 including the retainer 40, the housing for the two-barrel terminals 50 can be used as it is without having its design changed. As a result, the use of the three-barrel terminals 20 can be inexpensively dealt with.

The invention is not limited to the above described and illustrated embodiment. For example, the following embodiments are also included in the technical scope of the present invention.

Female terminal fittings and a female fluid- or waterproof connector are illustrated in the above embodiment. However, the invention is similarly applicable to male terminal fittings with male tabs and a male fluid- or waterproof connector.

Metal locking lances may be used for primary locking to prevent the terminal fittings from coming out of the cavities of the housing or the terminal fittings may be retained only by the retainer.

The dimensions, such as the length of the locking lances described above are merely examples and may be set depending on conditions, such as the entire lengths of the terminal fittings and the diameter of mating insulated wires.

The invention has been described with reference to a rubber plug. However the invention is applicable to a resilient plug made of any resilient material other than (natural or synthetic) rubber.

What is claimed is:

1. A terminal fitting fixed to an end of an insulated wire together with a resilient plug for insertion into a cavity of a housing and retained by a retainer mountable to project into the cavity, the terminal fitting having opposite front and rear ends and comprising:

a terminal main body at the front end of the terminal fitting and having an engageable portion engageable with the retainer, a coupling portion, a wire barrel, an insulation barrel and a resilient plug barrel successively arranged behind the terminal main body, the wire barrel being crimped into connection with an end of a core of the wire, the wire barrel and the insulation barrel having bottom plates arranged at a substantially common height, the insulation barrel having first and second barrel pieces standing up from lateral edges of the bottom plate of the terminal fitting and being crimped into connection with an insulating coating of the wire at positions for urging the insulated wire toward the bottom plate and the resilient plug barrel being crimped into connection with the resilient plug mounted on an outer circumferential surface of the insulating coating, the coupling portion standing up from opposite lateral edges of the bottom plate and defining a maximum height;

a front end portion of the wire barrel being crimped substantially flat to suppress a bend-up of an end of the core and a height of the crimped wire barrel being less than the maximum height of the coupling portion; and a front end portion of the wire barrel being insertable to a position substantially facing a projecting end of the retainer when the terminal fitting is inserted to a proper position in the cavity.

2. The terminal fitting of claim 1, wherein the wire barrel has two barrel pieces that stand up from opposite lateral edges of a base plate extending backward from a bottom plate of the terminal main body.

3. The terminal fitting of claim 2, wherein the barrel pieces are crimped to embrace the end of the core with projecting end edges thereof butted against each other.

4. The terminal fitting of claim 3, wherein a bellmouth is formed only at a rear end of the wire barrel.

5. The terminal fitting of claim 1, wherein the wire barrel is individually directly crimped and connected to the end of the core of the insulated wire and the insulation barrel is individually directly crimped and connected to the end of the insulating coating.

6. A connector, comprising:

a housing with opposite front and rear ends and at least one cavity extending between the front and rear ends;

a retainer formed separately from the housing and mounted in the housing at a specified location between the front and rear ends and movable into a position where a part of the retainer projects into the cavity; and at least one terminal fitting fixed to an end of an insulated wire together with a resilient plug and inserted in the cavity, the terminal fitting having opposite front and rear ends, a terminal main body at the front end of the terminal fitting and having an engageable portion engageable with the retainer, a coupling portion, a wire barrel having a bottom plate and lateral barrel pieces extending from lateral edges of the bottom plate, an insulation barrel having a bottom plate and lateral barrel pieces extending from lateral edges of the bottom plate and a resilient plug barrel successively arranged behind the terminal main body, the wire barrel being crimped into connection with an end of a core of the wire and being at a position between the front and rear ends of the housing to align with the part of the retainer that projects into the cavity, the insulation barrel being crimped into connection with an insulating coating of the wire and the resilient plug barrel being crimped into connection with the resilient plug mounted on an outer circumferential surface of the insulating coating, the bottom plates of the wire barrel and the insulation barrel arranged at low positions substantially at a common height, a front end portion of the wire barrel being crimped substantially flat to suppress a bend-up of an end of the core, the coupling portion standing up from lateral edges of the bottom plate and defining a maximum height greater than a height of the crimped wire barrel.

7. A connector, comprising:

a housing with at least one cavity;

at least one terminal fitting fixed to an end of an insulated wire together with a resilient plug and inserted in the cavity, the terminal fitting having opposite front and rear ends, a bottom plate and an upper portion spaced from the bottom plate, a terminal main body at the front end of the terminal fitting and having an engageable portion engageable with the retainer, a coupling rearward of the terminal main body, the coupling standing up from opposite lateral edges of the bottom plate and defining a maximum height, a wire barrel rearward of the coupling and being crimped into connection with an end of a core of the wire so that portions of the wire barrel adjacent the coupling portion are no higher than the maximum height of the coupling, an insulation barrel rearward of the wire barrel and being crimped into connection with an insulating coating of the wire, and a resilient plug barrel being crimped into connection with the resilient plug mounted on an outer circumferential surface of the insulating coating; and a retainer mounted in the housing and movable into a position where a part of the retainer projects into the cavity, the retainer being aligned with the coupling and parts of the wire barrel of the terminal fitting.

8. The connector of claim 7, further comprising a bellmouth projecting from a rearward upper portion of the wire barrel.

9. The connector of claim 7, wherein the insulating coating is above the bottom plate and below the barrel pieces when the wire barrel is in crimped connection with said insulating coating.

* * * * *